US006192706B1

(12) United States Patent
Bergman, Jr. et al.

(10) Patent No.: US 6,192,706 B1
(45) Date of Patent: Feb. 27, 2001

(54) CRYOGENIC SYSTEM FOR PRODUCING CARBON MONOXIDE

(75) Inventors: Thomas John Bergman, Jr., Clarence Center; John Fredric Billingham, Getzville; Michael Robert Couche, Williamsville; Minish Mahendra Shah, East Amherst, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/412,574

(22) Filed: Oct. 5, 1999

(51) Int. Cl.[7] ..... F25J 3/08

(52) U.S. Cl. ..... 62/624

(58) Field of Search ..... 62/920, 624, 620, 62/618

(56) References Cited

U.S. PATENT DOCUMENTS

| | | | |
|---|---|---|---|
| 4,566,886 | 1/1986 | Fabian et al. | 62/11 |
| 5,073,356 | 12/1991 | Guro et al. | 423/415 |
| 5,133,793 | 7/1992 | Billy | 62/23 |
| 5,295,356 | 3/1994 | Billy | 62/20 |
| 5,509,271 | 4/1996 | Billy et al. | 62/620 |
| 5,538,706 | 7/1996 | Kapoor et al. | 423/418.2 |
| 5,592,831 | 1/1997 | Bauer et al. | 62/625 |
| 5,609,040 | 3/1997 | Billy et al. | 62/622 |

*Primary Examiner*—Corrine McDermott
*Assistant Examiner*—Malik N. Drake
(74) *Attorney, Agent, or Firm*—Donald T. Black

(57) ABSTRACT

A system for producing carbon monoxide wherein a carbon monoxide containing feed stream is processed in a membrane separation unit for partial removal of carbon dioxide, cooled to complete the removal of carbon dioxide, and then processed in a cryogenic separation system comprising a first cryogenic separation column and a second cryogenic separation column for the production of product carbon monoxide.

11 Claims, 3 Drawing Sheets

CRYOGENIC SYSTEM FOR PRODUCING CARBON MONOXIDE

TECHNICAL FIELD

This invention relates generally to the production of carbon monoxide and is particularly useful for the production of carbon monoxide at relatively low production rates.

BACKGROUND ART

Carbon monoxide is used as a reactant in a number of important industrial chemical synthesis processes. Carbon monoxide may be produced by the partial oxidation of hydrocarbons followed by purification, including the removal of carbon dioxide using chemical based absorption typically involving an amine based reactant. While such a system is very effective for the production of carbon monoxide on a large scale, it is cost prohibitive for the production of carbon monoxide on a relatively small scale such as at a production rate of less than 50,000 cubic feet per hour.

Accordingly it is an object of this invention to provide an improved system for producing carbon monoxide which will enable effective production of carbon monoxide even at relatively low production rates.

SUMMARY OF THE INVENTION

The above and other objects, which will become apparent to those skilled in the art upon a reading of this disclosure, are attained by the present invention, one aspect of which is:

A method for producing carbon monoxide comprising:

(A) providing a feed comprising carbon monoxide, carbon dioxide, hydrogen and hydrocarbons, and passing the feed through a membrane separation unit to separate the feed into a permeate, which comprises some of the hydrogen and carbon dioxide of the feed, and into retentate which has a higher concentration of carbon monoxide than does the feed;

(B) cooling the retentate to remove essentially all of the remaining carbon dioxide, and passing the resulting fluid comprising carbon monoxide, hydrogen and hydrocarbons into a first cryogenic separation column as first column feed;

(C) separating the first column feed in the first cryogenic separation column into hydrogen top fluid and into bottom fluid comprising carbon monoxide and hydrocarbons;

(D) passing bottom fluid into a second cryogenic separation column and separating the bottom fluid in the second cryogenic separation column into carbon monoxide vapor and hydrocarbon liquid; and (E) recovering carbon monoxide vapor from the upper portion of the second cryogenic separation column as product carbon monoxide.

Another aspect of this invention is:

Apparatus for producing carbon monoxide comprising:

(A) a membrane separation unit and means for passing a feed comprising carbon monoxide, carbon dioxide, hydrogen and hydrocarbons to the membrane separation unit;

(B) a carbon dioxide removal cooler and means for passing fluid from the membrane separation unit to the carbon dioxide removal cooler;

(C) a first cryogenic separation column and means for passing fluid from the carbon dioxide removal cooler to the first cryogenic separation column;

(D) a second cryogenic separation column and means for passing fluid from the lower portion of the first cryogenic separation column into the second cryogenic separation column; and (E) means for recovering fluid from the upper portion of the second cryogenic separation column as product carbon monoxide.

As used herein the term "membrane separation unit" means a system which separates gas components from gas mixtures using polymeric membranes and employing gas concentration and pressure gradients across the membrane.

As used herein the term "carbon dioxide removal cooler" means a system which receives a gas stream comprising carbon dioxide and wherein the gas stream is cooled so as to condense and/or sublime carbon dioxide out from the gas stream.

As used herein the term "hydrocarbons" means one or more hydrocarbon species having up to 5 carbon atoms. Examples include methane, ethane, acetylene and propane.

As used herein the term "column" means a distillation or fractionation column or zone, i.e., a contacting column or zone wherein liquid and vapor phases as countercurrently contacted to effect separation of a fluid mixture, as for example, by contacting or the vapor and liquid phases on a series of vertically spaced trays or plates mounted within the column and/or on packing elements such as structured or random packing. For a further discussion of distillation columns, see the Chemical Engineer's Handbook fifth edition, edited by R. H. Perry and C. H. Chilton, McGraw-Hill Book Company, New York, Section 13, *The Continuous Distillation Process*. Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic separation is a separation process carried out in a column at least in part at temperatures at or below 150 degrees Kelvin (K).

As used herein the term "indirect heat exchange" means the bringing of two fluids into heat exchange relation without any physical contact or intermixing of the fluid with each other.

As used herein the terms "upper portion" and "lower portion" mean those sections of a column respectively above and below the mid point of the column.

DETAILED DESCRIPTION

In the practice of this invention, the production of carbon monoxide is achieved by managing the concentration levels of carbon dioxide in several elements of the system. This carbon dioxide management system enables the effective production of carbon monoxide, especially at relatively low production rates.

Figure 1:
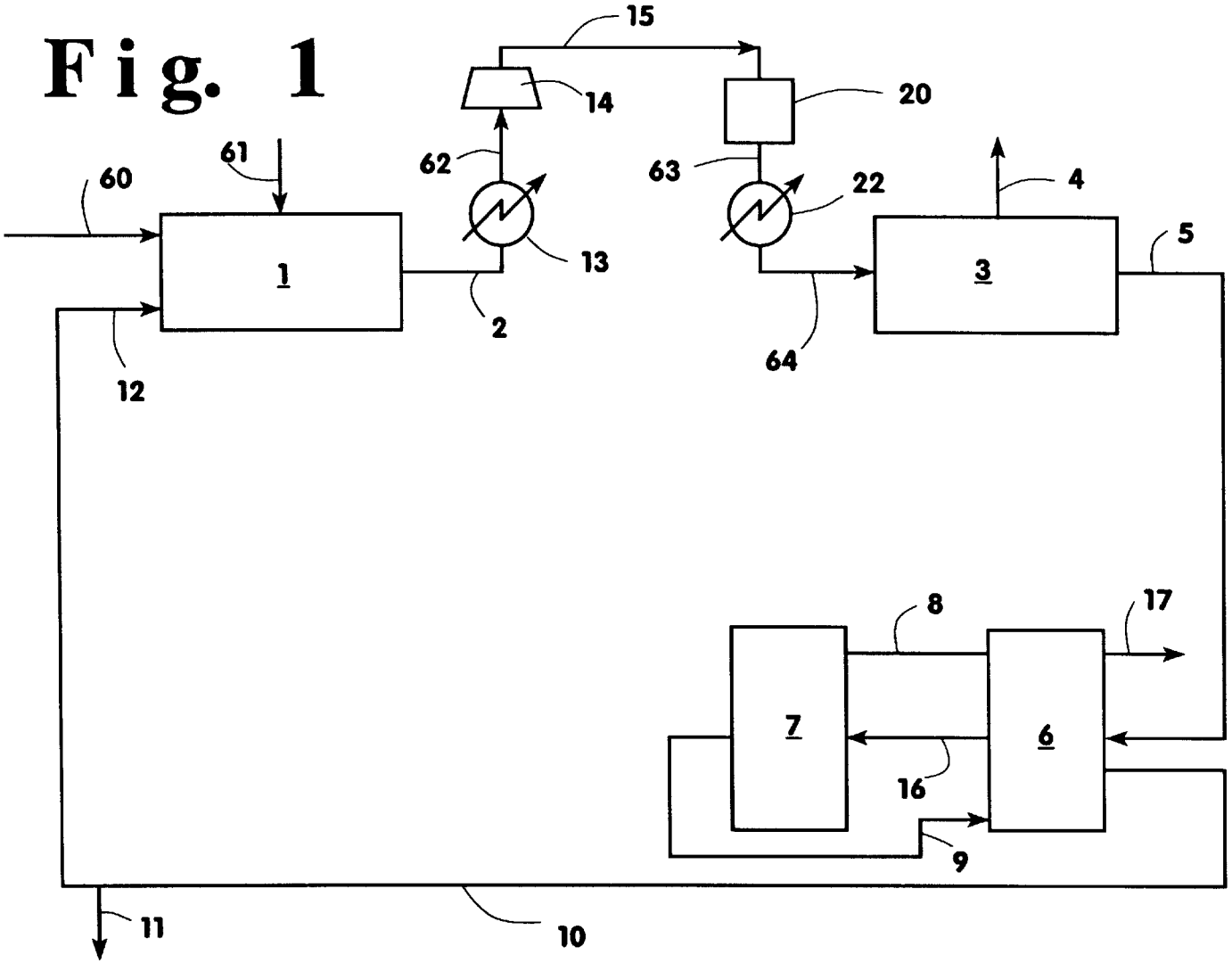
FIG. 1 is a simplified schematic flow diagram of one preferred embodiment of the carbon monoxide production system of this invention.

The invention will be described in greater detail with reference to the Drawings. FIG. 1 illustrates an arrangement wherein the feed for the carbon monoxide production system of the invention is taken from a synthesis gas generating reactor.

Referring now to FIG. 1, hydrocarbons stream 60 and oxygen stream 61 are provided into synthesis gas generating reactor 1 wherein they react to form a synthesis gas mixture. This synthesis gas mixture, which comprises carbon monoxide, carbon dioxide, hydrogen, water and hydrocarbons, and which may also comprise other components such as nitrogen, argon and hydrogen sulfide, is passed in stream 2 from reactor 1 to cooler 13 and from there in stream 62 to compressor 14 wherein it is compressed to a pressure generally within the range of from 50 to 1000 pounds per square inch absolute (psia). Resulting compressed stream 15, if necessary, is passed to desulfurization unit 20 wherein any sulfur compounds such as hydrogen sulfide are removed. Resulting stream 63 is further cooled by passage through cooler 22 and resulting stream 64 is passed as feed into membrane separation unit 3. Typically feed stream 64 comprises from 25 to 45 mole percent carbon monoxide, up to 10 mole percent carbon dioxide, from 30 to 60 mole percent hydrogen, and up to 10 mole percent hydrocarbons on a dry basis. Typically the feed stream into the membrane separation unit will have a flowrate within the range of from 10,000 to 200,000 cubic feet per hour (cfh), NTP.

Within membrane separation unit 3 the feed is separated into a permeate, which comprises some of the hydrogen and carbon dioxide of the feed along with carbon monoxide and water, and into a retentate which has a higher concentration of carbon monoxide than does the feed. Permeate is withdrawn from membrane separation unit 3 in stream 4 and retentate is removed from membrane separation unit 3 in retentate stream 5. Stream 5 comprises from 50 to 90 mole percent carbon monoxide on a dry basis along with carbon dioxide, hydrogen, hydrocarbons and water.

Retentate stream 5 is passed into carbon dioxide removal cooler 6 wherein it is cooled to a temperature sufficient to condense or sublime essentially all of the carbon dioxide out from the retentate. Any water vapor that may be in retentate stream 5 is also removed by the passage of stream 5 through cooler 6. Resulting stream 16 comprising carbon monoxide, hydrogen and hydrocarbons is passed from carbon dioxide removal cooler 6 to the cryogenic separation system, shown in FIG. 1 in block diagram form as item 7.

Figure 2:
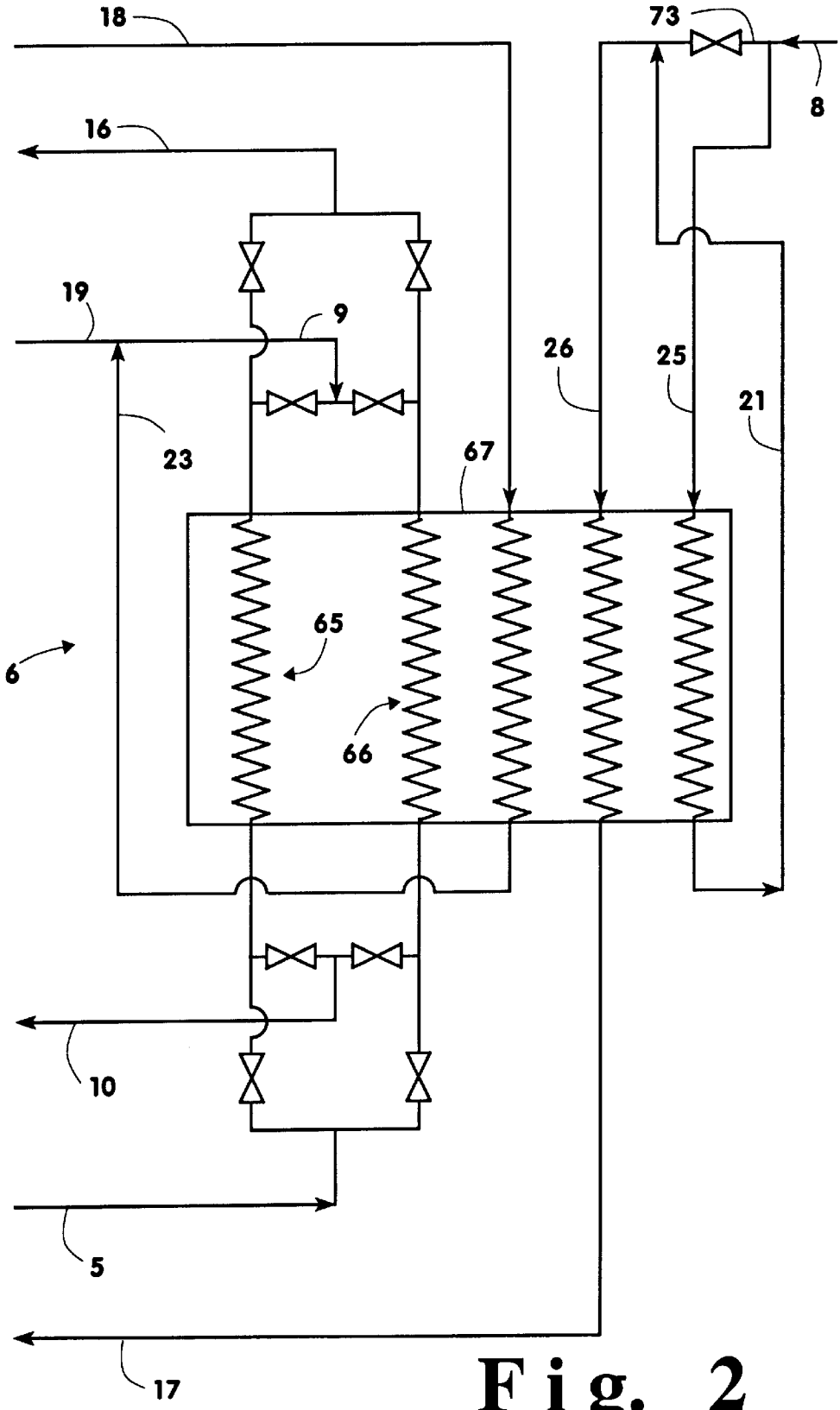
FIGS. 2 and 3 are more detailed diagrams of certain aspects of the system illustrated in FIG. 1. The numerals in the Figures are the same for the common elements.
Figure 3:
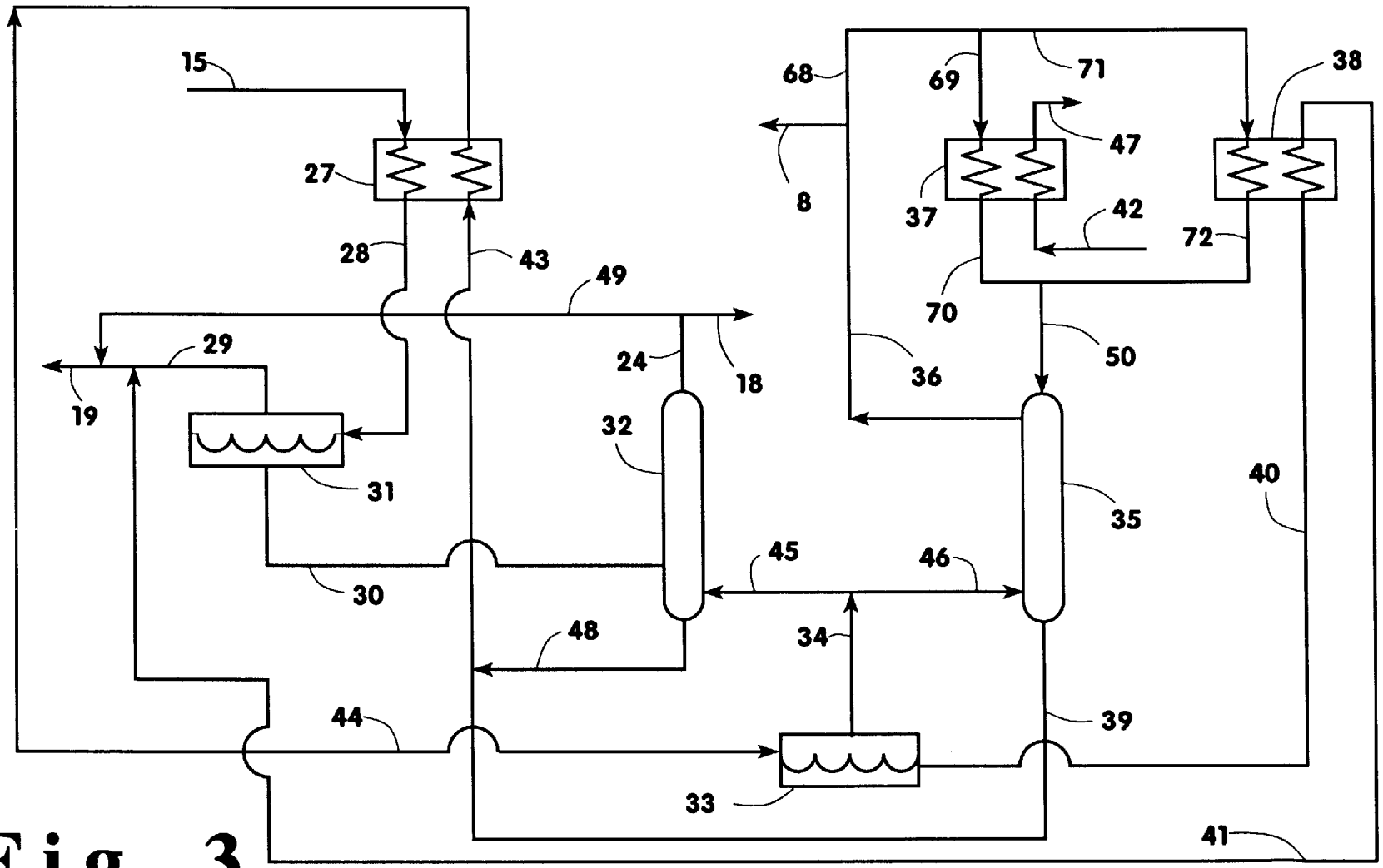

FIGS. 2 and 3 respectively illustrate in greater detail preferred embodiments of the carbon dioxide removal cooler and the cryogenic separation system which may be used in the practice of this invention. In FIG. 2 there is illustrated one embodiment of a reversing heat exchanger which may be used as the carbon dioxide removal cooler. A regenerator system may also be used as the carbon dioxide removal cooler in the practice of the invention.

Referring now to FIG. 2, retentate stream 5 is passed through one of either passage 65 or 66 of heat exchange 67 wherein stream 5 is cooled such that essentially all the carbon dioxide and water vapor in retentate stream 5 plates out onto the walls of the passage. Retentate stream 5 is periodically switched between passages 65 and 66 using the illustrated valve system when the passage that stream 5 is passing through becomes saturated with the deposited carbon dioxide and water vapor. The resulting stream 16 is then passed to the cryogenic separation system. Waste stream 18 taken from the cryogenic separation system is passed through heat exchanger 67 wherein it is warmed so as to serve by indirect heat exchange as a source of cooling for retentate stream 5. Resulting warmed stream 23 is combined with stream 19 which is also a waste stream from the cryogenic separation system to form sweep stream 9. Stream 9 is passed through one of either passage 65 or 66, i.e. the passage through which retentate stream 5 is not passing, and in the process the plated carbon dioxide and water vapor in that passage are passed into the sweep stream and the passage is cleaned for the next periodic flow therethrough of the retentate. Stream 9 is also warmed by passage through heat exchanger 67 thereby serving to cool retentate stream 5. The resulting carbon dioxide laden sweep stream 10, after venting via vent stream 11 to prevent carbon dioxide accumulation in the system, may be recycled in stream 12 to reactor 1 for additional production of synthesis gas mixture as shown in FIG. 1. Warming stream 18 through heat exchanger 67 prior to mixing with stream 19 enables control of the temperature difference between streams 26 and 16, ensuring that carbon dioxide deposited in heat exchanger 67 will be adequately removed.

Carbon monoxide product stream 8 from the cryogenic separation system is divided into streams 26 and 25. Stream 26 is warmed by passage through heat exchanger 67 thereby serving to cool by indirect heat exchange retentate stream 5. Resulting warmed stream 17 is recovered as product carbon monoxide. Stream 25 is warmed by passage through heat exchanger 67 thereby also serving to cool by indirect heat exchange retentate stream 5, and resulting stream 21 is cycled into stream 26 for passage through heat exchanger 67 and recovery in stream 17. Warming stream 25 through heat exchanger 17 prior to mixing with stream 73 enables control of the temperature difference between streams 26 and 16, ensuring that carbon dioxide deposited in heat exchanger 67 will be adequately removed.

A preferred embodiment of the cryogenic separation system for use in the practice of this invention is illustrated in FIG. 3. Referring now to FIG. 3, stream 16 comprising carbon monoxide, hydrogen and hydrocarbons is partially condensed by passage through heat exchanger or condenser/reboiler 27 and resulting two phase stream 28 is passed into phase separator 31. Vapor is passed out from phase separator 31 in stream 29 which is combined with other streams to form aforesaid waste stream 19. Liquid comprising carbon monoxide, hydrogen and hydrocarbons is passed out from phase separator 31 in stream 30 and passed as first column feed into first cryogenic separation column 32.

First cryogenic separation column 32 is operating at a pressure generally within the range of from 30 to 1000 psia. Within first column 32 the first column feed is separated by cryogenic separation into hydrogen-containing top fluid and into bottom fluid comprising carbon monoxide and hydrocarbons. Hydrogen top fluid is withdrawn from the upper portion of first column 32 in vapor stream 24. A first portion 18 of stream 24 is passed through heat exchanger 67 and further processed as previously described in conjunction with FIG. 2. A second portion 49 of stream 24 is combined with other streams to form the aforesaid waste stream 19.

Bottom fluid is withdrawn from the lower portion of first column 32 in liquid stream 48 and passed as stream 43 through reboiler/condenser 27 wherein it is partially vaporized by indirect heat exchange with partially condensing stream 16. Resulting two phase stream 44 is passed to phase separator 33. Liquid from phase separator 33 is passed in stream 40 to heat exchanger or condenser 39 wherein it is vaporized. Resulting vapor stream 41 is then combined with other streams to form aforesaid waste stream 19 which is further processed as was previously described in conjunction with FIG. 2.

Vapor is withdrawn from phase separator 33 in stream 34, a first portion 45 passed into first cryogenic separation column 32 and a second portion 46 passed as feed into second cryogenic separation column 35 which contains a rectification section and which is operating at a pressure generally within the range of from 30 to 1000 psia. Within second column 35 the bottom fluid 46 passed into that column is separated by cryogenic rectification into carbon monoxide vapor and hydrocarbon-containing liquid. It will be recognized by those skilled in the art that column 35 may also contain a stripping section located below the feed stage if the feed is to be a two phase fluid. Hydrocarbon liquid is withdrawn from the lower portion of second column 35 in stream 39 which is combined with stream 48 to form stream 43 which is processed as previously described. Carbon monoxide vapor is withdrawn from the upper portion of second cryogenic separation column 35 in stream 36 and a portion 8 of stream 36 is passed to the carbon dioxide removal cooler and then recovered in steam 17 as was previously described. Stream 17 has a carbon monoxide concentration of at least 50 mole percent and generally within the range of from about 95 to 100 mole percent. Typically the flowrate of stream 17 is less than 50,000 cfh, NTP.

The remaining portion 68 of stream 36 is condensed and returned to the upper portion of second column 35 as reflux. A first part 69 of stream 68 is condensed by passage through condenser 37 by indirect heat exchange with liquid nitrogen 42 which is vaporized and withdrawn as stream 47. Resulting condensed stream 70 is then passed into second column 35 as part of stream 50. A second part 71 of stream 68 is condensed by passage through condenser 38 by indirect heat exchange with liquid stream 40, and resulting condensed stream 72 is combined with stream 70 to form stream 50 for passage as reflux into second cryogenic separation column 35.

Although the invention has been described in detail with reference to a certain particularly preferred embodiment, those skilled in the art will recognize that there are other embodiments of the invention within the spirit and the scope of the claims.

What is claimed is:

1. A method for producing carbon monoxide comprising:

(A) providing a feed comprising carbon monoxide, carbon dioxide, hydrogen and hydrocarbons, and passing the feed through a membrane separation unit to separate the feed into a permeate, which comprises some of the hydrogen and carbon dioxide of the feed, and into retentate which has a higher concentration of carbon monoxide than does the feed;

(B) cooling the retentate to remove essentially all of the remaining carbon dioxide, and passing the resulting fluid comprising carbon monoxide, hydrogen and hydrocarbons into a first cryogenic separation column as first column feed;

(C) separating the first column feed in the first cryogenic separation column into hydrogen top fluid and into bottom fluid comprising carbon monoxide and hydrocarbons;

(D) passing bottom fluid into a second cryogenic separation column and separating the bottom fluid in the second cryogenic separation column into carbon monoxide vapor and hydrocarbon liquid; and (E) recovering carbon monoxide vapor from the upper portion of the second cryogenic separation column as product carbon monoxide.

2. The method of claim 1 wherein hydrogen top fluid is warmed to effect cooling of the retentate.

3. The method of claim 1 wherein carbon monoxide vapor is warmed by indirect heat exchange with the retentate prior to recovery of the carbon monoxide vapor as product carbon monoxide.

4. Apparatus for producing carbon monoxide comprising:

(A) a membrane separation unit and means for passing a feed comprising carbon monoxide, carbon dioxide, hydrogen and hydrocarbons to the membrane separation unit;

(B) a carbon dioxide removal cooler and means for passing fluid from the membrane separation unit to the carbon dioxide removal cooler;

(C) a first cryogenic separation column and means for passing fluid from the carbon dioxide removal cooler to the first cryogenic separation column;

(D) a second cryogenic separation column and means for passing fluid from the lower portion of the first cryogenic separation column into the second cryogenic separation column; and (E) means for recovering fluid from the upper portion of the second cryogenic separation column as product carbon monoxide.

5. The apparatus of claim 4 wherein the carbon dioxide removal cooler comprises a reversing heat exchanger.

6. The apparatus of claim 4 further comprising means for passing fluid from the upper portion of the first cryogenic separation column to the carbon dioxide removal cooler.

7. The apparatus of claim 4 where in the means for recovering fluid from the upper portion of the second cryogenic separation column as product carbon monoxide includes the carbon dioxide removal cooler.

8. The apparatus of claim 4 further comprising means for passing fluid from the lower portion of the second cryogenic separation column into the lower portion of the first cryogenic separation column.

9. The apparatus of claim 4 further comprising a synthesis gas generating reactor and means for passing hydrocarbons and oxygen into the synthesis gas generating reactor, wherein the means for passing feed to the membrane separation unit passes from the synthesis gas generating reactor to the membrane separation unit, and further comprising means for passing fluid from the carbon dioxide removal cooler to the synthesis gas generation reactor.

10. The apparatus of claim 4 wherein the means for passing fluid from the carbon dioxide removal cooler to the first cryogenic separation column includes a reboiler/condenser.

11. The apparatus of claim 4 wherein the means for passing fluid from the lower portion of the first cryogenic separation column into the second cryogenic separation column includes a reboiler/condenser and a phase separator, and further comprising means for passing fluid from the phase separator into the lower portion of the first cryogenic separation column.

* * * * *